US007438501B2

(12) United States Patent
Sopko

(10) Patent No.: US 7,438,501 B2
(45) Date of Patent: Oct. 21, 2008

(54) GROUND FREEZING INSTALLATION ACCOMMODATING THERMAL CONTRACTION OF METAL FEED PIPES

(75) Inventor: Joseph A. Sopko, Cedar Grove, WI (US)

(73) Assignee: Layne Christensen Company, Mission Woods, KS (US)

( * ) Notice: Subject to any disclaimer, the term of this patent is extended or adjusted under 35 U.S.C. 154(b) by 173 days.

(21) Appl. No.: 11/383,691

(22) Filed: May 16, 2006

(65) Prior Publication Data

US 2007/0267190 A1 Nov. 22, 2007

(51) Int. Cl.
*F25C 1/00* (2006.01)

(52) U.S. Cl. ..... 405/130; 165/45; 62/160

(58) Field of Classification Search ..... 405/130, 405/232; 165/45; 62/260
See application file for complete search history.

(56) References Cited

U.S. PATENT DOCUMENTS 3,609,980 A 10/1971 Bowers
3,720,065 A 3/1973 Sherard
3,943,722 A 3/1976 Ross
4,286,651 A 9/1981 Steiger et al.
4,325,228 A 4/1982 Wolf
4,448,237 A 5/1984 Riley
4,574,875 A 3/1986 Rawlings et al.
4,912,941 A 4/1990 Buchi
5,533,356 A 7/1996 DeMasters
6,796,139 B2 9/2004 Briley et al.
7,128,153 B2 * 10/2006 Vinegar et al. ..... 166/285

* cited by examiner

*Primary Examiner*—Tara L. Mayo
(74) *Attorney, Agent, or Firm*—Husch Blackwell Sanders LLP

(57) ABSTRACT

A ground freezing system includes a metal feed pipe for delivering refrigerant to the lower end of a freeze pipe installed in a bore in the ground. The feed pipe is supported on a compression spring which accommodates thermal contraction of the feed pipe while maintaining support of its weight.

14 Claims, 1 Drawing Sheet

GROUND FREEZING INSTALLATION ACCOMMODATING THERMAL CONTRACTION OF METAL FEED PIPES

FIELD OF THE INVENTION

This invention relates generally to ground freezing which involves the application of refrigerant to subterranean pipes. More specifically, the invention is directed to a ground freezing pipe system which is specially arranged to accommodate thermal contraction of a feed pipe that delivers refrigerant to the base area of the bore in which the pipes are installed.

BACKGROUND OF THE INVENTION

Artificial ground freezing is a technique that has been used for a variety of purposes. Most commonly, ground freezing is used to provide support or containment for excavations or to provide subterranean barriers against water seepage or the spreading of contaminants. Frozen underground barriers have also been formed to create impermeable zones for use in the extraction or processing of minerals.

A typical ground freezing system involves drilling a bore in the earth and lining it with a steel freeze pipe. Refrigerant is pumped to the base area of the freeze pipe through a smaller feed pipe that extends within the freeze pipe. As the refrigerant flows upwardly within the freeze pipe, it extracts heat from the earth around the bore and eventually freezes the interstitial water to create an area of frozen soil that can exhibit compressive strength as great as some types of concrete. a number of bores are strategically situated such that the frozen zones from adjacent bores merge to form a continuous barrier.

In some ground freezing applications, it is necessary to create frozen barriers that extend to considerable depths. For example, ground freezing to depths of 1000 feet or more has been achieved. However, the need to freeze the ground to substantial depths leads to complications. One example is that thermal contraction effects become increasingly pronounced as the pipes increase in length. The feed pipes are typically constructed of high density polyethylene (HDPE). HDPE has a relatively large coefficient of thermal expansion, so long pipes contract significantly when cooled by the refrigerant. As a result, the bottom discharge end of the pipe can rise so much that the lower end portion of the freeze pipe fails to receive refrigerant. Then, the lower part of the bore remains unfrozen.

Although metals such as steel contract much less than HDPE due to thermal effects, such metals are also much heavier and must be supported from the bottom. However, when long metal feed pipes are cooled, they contract enough to rise above conventional bottom support systems such that the pipe weight is then borne by a fitting at the top end of the feed pipe. This can exert undue stress on the top fitting and cause the feed pipe to detach from it, resulting in a structural failure.

SUMMARY OF THE INVENTION

The present invention provides a novel solution to the problem of feed pipe thermal contraction in a ground freezing system. In accordance with the invention, the feed pipe is constructed of metal, preferably steel, so that its thermal contraction is much reduced compared to HDPE pipes. To accommodate the thermal contraction that does occur, a resilient mounting element such as a compression spring supports the feed pipe at the bottom of the bore. The spring or other resilient mounting structure is able to expand as the lower end of the feed pipe is drawn upwardly due to thermal contraction. The mounting system is thus able to maintain support of the feed pipe as thermal contraction occurs so that undue stresses are not exerted at the top fitting of the pipe system.

Other and further objects of the invention, together with the features of novelty appurtenant thereto, will appear in the course of the following description.

DESCRIPTION OF THE DRAWING

In the accompanying drawing which forms a part of the specification and is to be read in conjunction therewith.

DESCRIPTION OF THE PREFERRED EMBODIMENT

Figure 1:
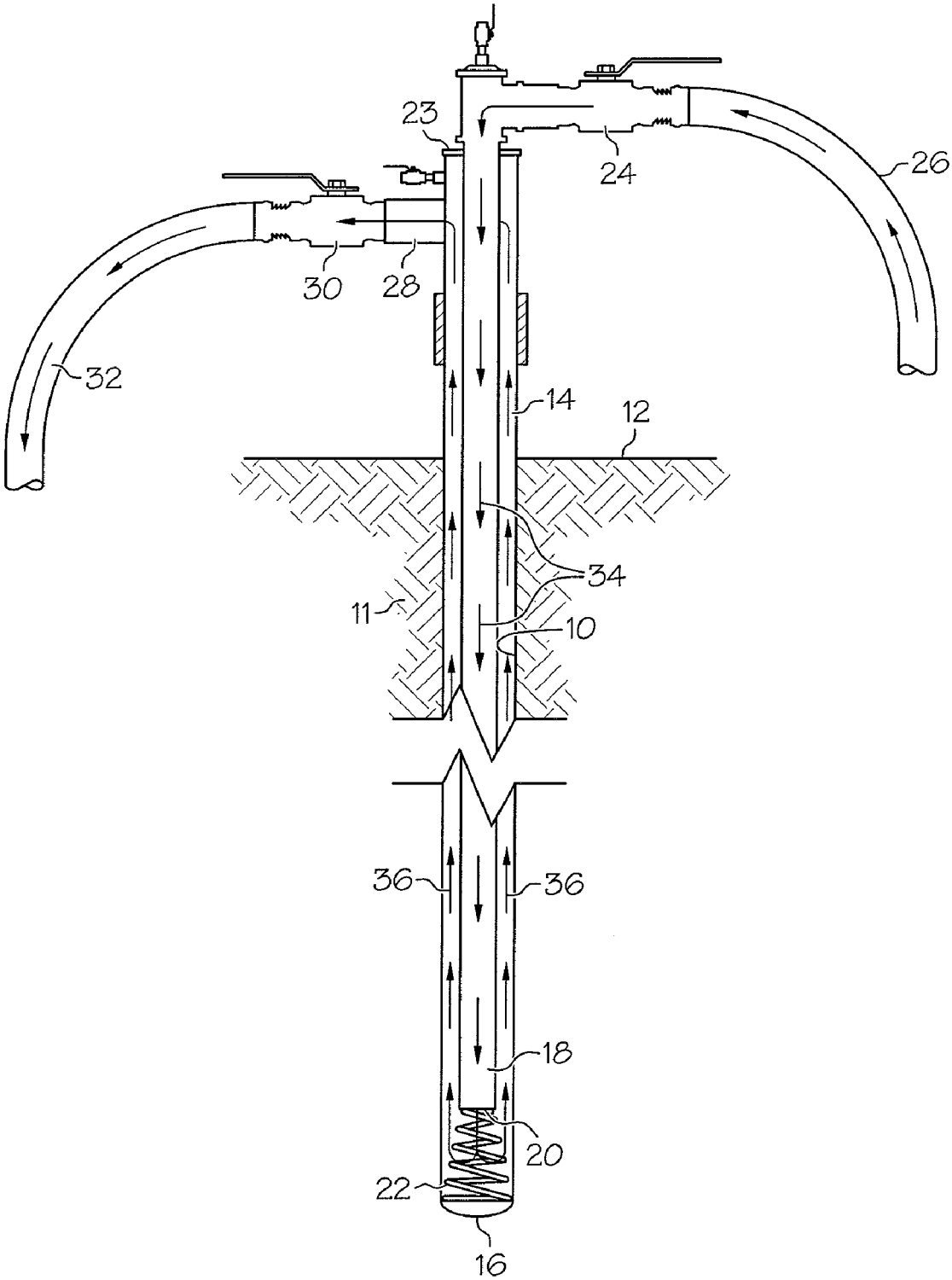
FIG. 1 is a sectional diagrammatic view of a ground freezing installation equipped with a feed pipe support arrangement constructed according to a preferred embodiment of the present invention.

FIG. 1 depicts a ground freezing system that is installed in a vertical bore 10 which is drilled or otherwise formed to extend downwardly into the ground 11 from the ground surface 12. a cylindrical metal freeze pipe 14 is installed in the bore 10 and extends downwardly in the bore to its bottom or base end 16. The freeze pipe 14 fits closely in the bore 10. a feed pipe 18 which is smaller in diameter than the freeze pipe extends concentrically within the freeze pipe 14. The upper end of the feed pipe 18 is located above the ground surface 12, and the feed pipe 18 has a lower discharge end 20 which is open in order to discharge refrigerant into the freeze pipe 14 at the bottom end portion of the freeze pipe. The discharge end 20 of the feed pipe is spaced above the bottom 16 of the bore. In accordance with the invention, the feed pipe 18 is constructed of metal and is preferably constructed of steel.

The feed pipe 18 is supported at its lower end by a resilient element which may take the form of a compression spring 22 interposed between the base 16 of the bore 10 and the lower end 20 of the feed pipe. The spring 22 may be a conventional coiled compression spring. The spring 22 is constructed such that it is in a state of compression when the feed pipe 18 is not subjected to the cooling effects of refrigerant. The spring 22 is compressed between the base 16 of bore 10 and the feed pipe 18 in order to support the weight of the feed pipe. The spring 22 is able to expand in order to maintain support of the weight of the feed pipe 18 if the feed pipe contracts such that its lower end 20 rises due to thermal contraction.

The upper end of the feed pipe 18 extends through a fitting 23 on the top end of the freeze pipe 14. The upper end of pipe 18 is connected through a valve 24 with a supply hose 26. The supply hose 26 extends from a suitable source of refrigerant (not shown) and is able to direct the refrigerant from the hose 26 through valve 24 to the feed pipe 18.

At a location above the level of the ground surface 12, the freeze pipe 14 is provided with a horizontal discharge pipe 28 on one side. The discharge pipe 28 connects through a valve 30 with a discharge hose 32 which directs refrigerant from the freeze pipe to a refrigeration plant or other apparatus that may cool the refrigerant for use in another bore.

In operation of the ground freezing system, a suitable refrigerant is pumped through hose 26 and valve 24 into the upper end of the feed pipe 18. The refrigerant is pumped downwardly through the freeze pipe 18 as indicated by the directional arrows 34. The refrigerant is discharged from freeze pipe 18 through its open lower ends 20 and into the bottom end portion of the freeze pipe 14. The refrigerant then flows upwardly within the freeze pipe 14 as indicated by the directional arrows 36, thereby extracting heat from the ground 11 that surrounds the well bore 10. Eventually, the ground 11 freezes. The refrigerant that passes through the freeze pipe 14 is discharged through pipe 28, valve 30 and the discharge hose 32.

As the refrigerant is pumped through the feed pipe 18, the feed pipe is cooled to a low temperature and contracts as a result of thermal contraction. Consequently, the discharge end 20 of the feed pipe moves upwardly. The presence of the spring 22 and its ability to expand due to its resiliency allows the lower end 20 of the feed pipe to rise while the spring 22 is able to maintain its support of the weight of the feed pipe 18. Therefore, undue stress on the top fitting 23 or other part of pipe system is avoided.

In this manner, the effects of thermal contraction are accommodated while maintaining support of the feed pipe weight from beneath the feed pipe. By constructing the feed pipe 18 of a metal such as steel, its thermal contraction is minimized so that the lower end 20 does not rise sufficiently to exceed the capacity of the spring 22 to maintain support of the feed pipe. Thus, adequate structural support of the feed pipe 18 is maintained while the bottom end portion of the freeze pipe 14 down to the bore base 16 is supplied with refrigerant to effect freezing around the entire depth of the bore 10.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense

The invention claimed is:

1. Apparatus for freezing ground around a bore extending into the ground from the ground surface, said apparatus comprising:

a freeze pipe installed in the bore and having a lower end near a base of the bore;

a feed pipe in said freeze pipe having an upper end portion receiving a refrigerant, said feed pipe comprising metal and having a bottom discharge end located above said base of the bore through which the refrigerant is discharged into the freeze pipe and flows upwardly therein to extract heat from the ground around the bore; and a resilient element interposed between said discharge end of said feed pipe and said base of the bore supporting the feed pipe in a manner accommodating thermal contraction thereof while maintaining support of the feed pipe on said resilient element.

2. Apparatus as set forth in claim 1, wherein said resilient element comprises a compression spring.

3. Apparatus as set forth in claim 1, wherein said feed pipe comprises steel.

4. Apparatus as set forth in claim 3, wherein said resilient element comprises a compression spring.

5. Ground freezing apparatus comprising:

a bore extending from a ground surface into the ground and terminating at a base;

a freeze pipe installed in said bore;

a metal feed pipe extending within said freeze pipe and having a discharge end discharging refrigerant into said freeze pipe near said base in a manner to effect upward flow of the refrigerant in the freeze pipe to effect freezing of the ground around said bore; and resilient means beneath said feed pipe supporting the weight of the feed pipe while accommodating thermal contraction thereof due to the cooling effect of the refrigerant.

6. Apparatus as set forth in claim 5, wherein said resilient means comprises a compressible element able to expand when said discharge end of the feed pipe rises upon thermal contraction of the feed pipe.

7. Apparatus as set forth in claim 6, wherein said compressible element comprises a compression spring.

8. Apparatus as set forth in claim 7, wherein said feed pipe comprises steel.

9. Apparatus as set forth in claim 5, wherein said feed pipe comprises steel.

10. A ground freezing installation comprising:

a bore extending into the ground from a surface thereof and terminating at a base;

a freeze pipe lining said bore;

a metal feed pipe having an upper end portion receiving refrigerant and a lower end portion discharging the refrigerant into said freeze pipe above said base to effect upward flow of the refrigerant in the freeze pipe for freezing of the ground around the bore;

a refrigerant supply operable to apply refrigerant to said upper end portion of the feed pipe;

a refrigerant collection conduit collecting refrigerant from the freeze pipe at a location near the ground surface; and means beneath said feed pipe for supporting the weight of the feed pipe and accommodating thermal contraction thereof.

11. An installation as set forth in claim 10, wherein said means beneath said feed pipe comprises a compressible element extending between said base of the bore and said lower end portion of the feed pipe, said compressible element being constructed to expand to maintain support of the feed pipe upon rising of said lower end due to thermal contraction of the feed pipe.

12. An installation as set forth in claim 11, wherein said compressible element comprises a compression spring.

13. An installation as set forth in claim 12, wherein said feed pipe comprises steel.

14. An installation as set forth in claim 10, wherein said feed pipe comprises steel.

* * * * *